US010535301B2

(12) United States Patent
Chae et al.

(10) Patent No.: US 10,535,301 B2
(45) Date of Patent: Jan. 14, 2020

(54) DATA DRIVER AND DRIVING METHOD THEREOF

(71) Applicant: Samsung Display Co., Ltd., Yongin-si, Gyeonggi-do (KR)

(72) Inventors: Se Byung Chae, Yongin-si (KR); Weon Jun Choe, Yongin-si (KR); Jin Young Jeon, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 106 days.

(21) Appl. No.: 15/835,121

(22) Filed: Dec. 7, 2017

(65) Prior Publication Data

US 2018/0158408 A1 Jun. 7, 2018

(30) Foreign Application Priority Data

Dec. 7, 2016 (KR) ..... 10-2016-0165868

(51) Int. Cl.
*G09G 3/3233* (2016.01)

(52) U.S. Cl.
CPC ... *G09G 3/3233* (2013.01); *G09G 2310/0264* (2013.01); *G09G 2330/021* (2013.01)

(58) Field of Classification Search
CPC ..... G09G 3/3233; G09G 3/20; G09G 2310/0275; G09G 3/3685; G09G 3/3275; G09G 2310/0291; G09G 2330/021; G09G 2310/0264
See application file for complete search history.

(56) References Cited

U.S. PATENT DOCUMENTS

| | | | | |
|---|---|---|---|---|
| 7,317,440 | B2 | 1/2008 | Chung | |
| 2007/0195054 | A1 | 8/2007 | Kwon | |
| 2008/0278473 | A1 | 11/2008 | An | |
| 2011/0050749 | A1* | 3/2011 | Park | G09G 3/20 345/690 |
| 2011/0248982 | A1* | 10/2011 | Chuang | G09G 3/3685 345/212 |
| 2013/0307838 | A1* | 11/2013 | Kim | G09G 5/001 345/212 |
| 2014/0035963 | A1* | 2/2014 | Yang | G09G 3/2007 345/690 |

(Continued)

FOREIGN PATENT DOCUMENTS

| | | | |
|---|---|---|---|
| KR | 10-0486254 | B1 | 5/2005 |
| KR | 10-0712553 | B1 | 5/2007 |

(Continued)

*Primary Examiner* — Nitin Patel
*Assistant Examiner* — Amy Onyekaba
(74) *Attorney, Agent, or Firm* — Lewis Roca Rothgerber Christie LLP

(57) ABSTRACT

A data driver includes an input unit configured to receive data from outside, a digital-analog converter configured to generate a data signal by using the data, a data comparator configured to compare a reference gray scale value with the data and to generate a first control signal or a second control signal corresponding to a comparison result, and an output unit configured to supply the data signal to data lines, wherein the output unit includes at least one buffer, and a slew rate of the at least one buffer is set to vary depending on whether the first control signal or the second control signal is generated.

16 Claims, 7 Drawing Sheets

(56) References Cited

U.S. PATENT DOCUMENTS

| | | | | |
|---|---|---|---|---|
| 2014/0204071 | A1* | 7/2014 | Kwon | G09G 3/3291 345/212 |
| 2014/0306979 | A1* | 10/2014 | Chun | G09G 3/12 345/589 |
| 2015/0042395 | A1* | 2/2015 | Yang | G09G 3/22 327/333 |
| 2015/0130851 | A1* | 5/2015 | Jeong | G09G 3/20 345/690 |
| 2015/0325200 | A1* | 11/2015 | Rho | G09G 3/20 345/212 |
| 2016/0078841 | A1 | 3/2016 | Park et al. | |
| 2016/0093270 | A1 | 3/2016 | Lee et al. | |
| 2016/0180764 | A1* | 6/2016 | Noh | G09G 3/2018 345/690 |
| 2016/0275897 | A1 | 9/2016 | Lin et al. | |
| 2016/0308513 | A1 | 10/2016 | Park et al. | |

FOREIGN PATENT DOCUMENTS

| | | | |
|---|---|---|---|
| KR | 10-0861921 | B1 | 10/2008 |
| KR | 10-2012-0120517 | A | 11/2012 |
| KR | 10-2016-0032772 | A | 3/2016 |
| KR | 10-2016-0037010 | A | 4/2016 |
| KR | 10-2016-0123450 | A | 10/2016 |

* cited by examiner

DATA DRIVER AND DRIVING METHOD THEREOF

CROSS-REFERENCE TO RELATED APPLICATION

This application claims priority to and the benefit of Korean Patent Application No. 10-2016-0165868, filed on Dec. 7, 2016, in the Korean Intellectual Property Office, the entire content of which is incorporated herein by reference in its entirety.

BACKGROUND

1. Field

Aspects of embodiments of the present disclosure relate to a data driver and a driving method thereof, and more particularly, to a data driver capable of reducing power consumption and a driving method thereof.

2. Description of the Related Art

With the development of information technology, the importance of a display device as a connection medium between a user and information has been emphasized, and the use of display devices such as a liquid crystal display device and an organic light emitting display device has been increasing.

In general, a display device may include a data driver for supplying data signals to data lines, a scan driver for supplying scan signals to scan lines, and pixels connected to the scan lines and the data lines.

The data driver may generate a data signal by using data supplied from an outside and supply the generated data signal to a pixel via a data line. The data driver may include a buffer connected to each of the data lines.

The buffer may transmit the data signal supplied thereto to the data line. A slew rate of the buffer may be determined corresponding to a bias current (or a voltage). When the bias current is high, the slew rate may increase to reduce the charging time of the pixel, but increase power consumption. On the other hand, when the bias current is low, the power consumption may be reduced, but the charging time of the pixel may increase because the slew rate is reduced.

Therefore, it is desirable to provide a data driver capable of reducing power consumption and ensuring driving stability by controlling a bias current supplied to a buffer corresponding to data.

SUMMARY

Aspects of the present disclosure are directed to a data driver capable of reducing power consumption and ensuring driving stability and a driving method thereof.

According to an embodiment of the present disclosure, there is provided a data driver including an input unit configured to receive data from outside, a digital-analog converter configured to generate a data signal by using the data, a data comparator configured to compare a reference gray scale value with the data and to generate a first control signal or a second control signal corresponding to a comparison result, and an output unit configured to supply the data signal to data lines, wherein the output unit includes at least one buffer, and a slew rate of the at least one buffer is set to vary depending on whether the first control signal or the second control signal is generated.

The reference gray scale value may be set to a gray scale value of 10% or less when a gray scale range expressed with the data is set to 100%.

The reference gray scale value may be set to a black gray scale value.

The data driver may further include a memory configured to store the reference gray scale value.

The data comparator may be configured to compare the reference gray scale value with the data for each of a plurality of channels.

The data comparator may be configured to generate the first control signal when a gray scale value of data corresponding to an ith (i is a natural number) channel is more than the reference gray scale value, and the second control signal when the gray scale value of the data is set to the reference gray scale value or less.

The output unit may be configured to supply a first bias current to the at least one buffer in response to the first control signal, and a second bias current, having a lower current value than the first bias current, to the at least one buffer in response to the second control signal.

The output unit may include a bias current generator configured to generate a first bias current and a second bias current having a lower current value than the first bias current, and a buffer unit including the at least one buffer and being configured to supply the data signal to the data lines.

The buffer unit may include a plurality of buffers comprising the at least one buffer, each of the channels corresponding to a respective one of the plurality of buffers, wherein the slew rate of each of the plurality of buffers is configured to be controlled corresponding to a bias current, and a switch unit disposed at each of the channels and configured to supply the first bias current to the at least one buffer when the first control signal is supplied, and the second bias current, having the lower current value than the first bias current, to the at least one buffer when the second control signal is supplied.

The data comparator may be configured to compare the reference gray scale value with the data on a per horizontal line basis.

The data comparator may be configured to generate the first control signal when at least one of data corresponding to one horizontal line is more than the reference gray scale value, and otherwise may be configured to generate the second control signal.

The output unit may be configured to supply a first bias current to the at least one buffer in response to the first control signal and a second bias current, having a lower current value than the first bias current, to the at least one buffer in response to the second control signal.

The output unit may include a current generator configured to generate a first bias current and a second bias current having a lower current value than the first bias current, a switch unit configured to output the first bias current when the first control signal is input, and to output the second bias current when the second control signal is input, and the at least one buffer on each of a plurality of channels, wherein the slew rate thereof is configured to be controlled corresponding to the first bias current or the second bias current supplied from the switch unit.

The input unit may include a shift register unit configured to sequentially output a sampling pulse, a sampling latch unit configured to sequentially store the data corresponding to the sampling pulse, and a holding latch unit configured to receive and to store the data from the sampling latch unit and to supply stored data to the digital-analog converter.

The sampling latch unit is configured to supply the data to the data comparator.

The holding latch unit is configured to supply the data to the data comparator.

According to an embodiment of the present disclosure, there is provided a method of driving a data driver, the method including: receiving data, comparing the data with a reference gray scale value, and controlling a slew rate of a buffer included in each of a plurality of channels corresponding to a comparison result.

The reference gray scale value may be set to a gray scale value of 10% or less when a gray scale range expressed with the data is set to 100%.

The comparing of the data with the reference gray scale value may include comparing the data with the reference gray scale value for each of the channels or on a per horizontal line basis.

The buffer may have a first slew rate when the data is more than the reference gray scale value, and the buffer may have a second slew rate, which is lower than the first slew rate, when the data is the reference gray scale value or less.

DETAILED DESCRIPTION

Figure 1:
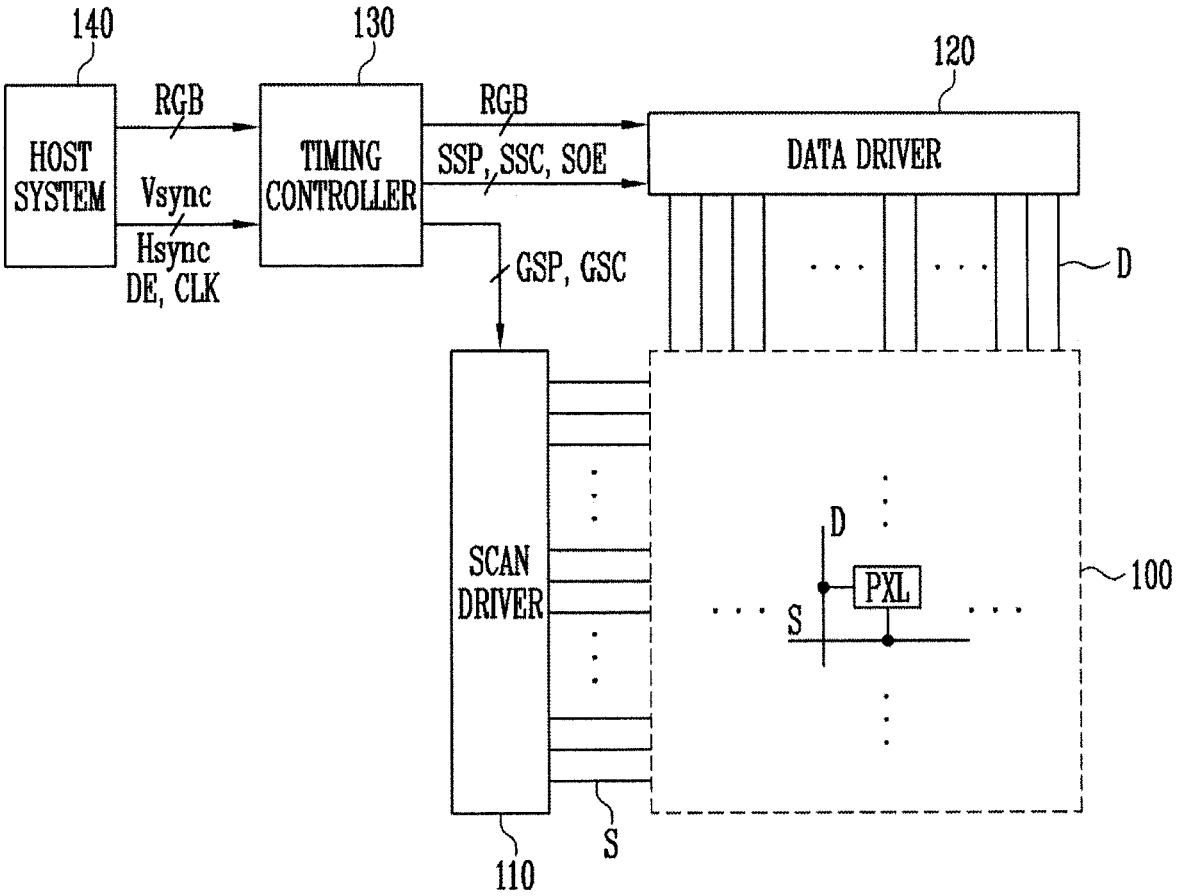
FIG. 1 is a schematic view illustrating a display device according to an embodiment of the present disclosure.

Hereinafter, embodiments of the present disclosure will be described in detail with reference to the accompanying drawings. However, the present disclosure may be embodied in many different forms within the scope of the appended claims, so that the embodiments described below are exemplary only, regardless of whether they are expressed or not.

That is, the present disclosure is not limited to the embodiments described below, but may be embodied in various forms. In the following description, when a part is connected to another part, it can be directly on another element or be on another element with one or more intervening elements (or components) interposed therebetween. It is to be noted that like elements (or components) in the drawings are denoted by the same reference numerals and marks although they may be shown in different drawings.

FIG. 1 is a schematic view illustrating a display device according to an embodiment of the present disclosure.

Referring to FIG. 1, a display device according to an embodiment of the present disclosure may include a display unit 100 (or a pixel unit), a scan driver 110, a data driver 120, a timing controller 130, and a host system 140.

The display unit 100 may include a plurality of pixels PXL positioned to be connected to data lines D and scan lines S. The pixels PXL may supply light with a luminance (e.g., a predetermined luminance) to an outside in response to a data signal.

When the display device is set to an organic light emitting display device, each of the pixels PXL may include a plurality of transistors, including a driving transistor, and an organic light emitting diode. The pixel PXL may be selected when a scan signal is supplied to the scan line S and supplied with the data signal from the data line D. The driving transistor included in the pixel PXL may supply a current corresponding to the data signal to the organic light emitting diode, so that light with the luminance (e.g., the predetermined luminance) may be generated by the organic light emitting diode.

When the display device is a liquid crystal display device, each of the pixels PXL may include a switching transistor and a liquid crystal capacitor. The pixel PXL may be selected when the scan signal is supplied to the scan line S and supplied with the data signal from the data line D. The pixel PXL may control the transmittance of liquid crystal in response to the data signal so that the light with the luminance (e.g., the predetermined luminance) may be supplied to the outside.

Additionally, in FIG. 1, the pixel PXL is illustrated to be connected to one data line D and one scan line S, but the present disclosure is not limited thereto. For example, various suitable signal lines may be additionally connected to the pixel PXL according to the circuit structure of the pixel PXL. That is, in an embodiment of the present disclosure, the pixel PXL may be embodied in various suitable forms currently known to those skilled in the art.

The data driver 120 may generate data signals by using data RGB input from the timing controller 130. The data signals generated by the data driver 120 may be supplied to the data lines D via a buffer located in each of the channels.

In an embodiment of the present disclosure, a bias current value supplied to buffers corresponding to gray scale values of the data RGB may be controlled. For example, when a data signal of high gray scale value is supplied to the pixel PXL, the bias current value may be set to cause the buffer to have a high slew rate. As a result, the data signal of high gray scale value may be stably charged to the pixel PXL.

Further, when a data signal of low gray scale value is supplied to the pixel PXL, the bias current value may be set to cause the buffer to have a low slew rate. For example, the data signal of low gray scale value may be stably charged to the pixel PXL although the buffer has a low slew rate. When the bias current value is set to cause the buffer to have a low slew rate, power consumption may be reduced.

In addition, a gamma voltage unit may be additionally provided inside or outside the data driver 120. The gamma voltage unit may supply a plurality of gamma signals to the data driver 120. The data driver 120 may generate a data signal by selecting one of the plurality of gamma signals corresponding to the gray scale values of the data RGB.

The scan driver 110 may supply the scan signals to the scan lines S. For example, the scan driver 110 may sequentially supply the scan signals to the scan lines S. When the scan signals are sequentially supplied to the scan lines S, the pixels PXL may be selected on a per horizontal line basis (or a horizontal line-by-horizontal line basis). The data signals supplied to the data lines D may be supplied to the pixels PXL selected by the scan signals. The scan driver 110 may be mounted on a substrate. That is, the scan driver 110 may be mounted on the substrate by performing a thin film process. In addition, the scan driver 110 may be mounted on both sides of the substrate with the display unit 100 interposed therebetween.

The timing controller 130 may supply a gate control signal to the scan driver 110 and a data control signal to the data driver 120 on the basis of the data RGB and timing signals such as a vertical synchronization signal Vsync, a horizontal synchronization signal Hsync, and a data enable signal DE output from the host system 140.

The gate control signal may include a gate start pulse GSP and at least one gate shift clock GSC. The gate start pulse GSP may control the timing of a first scan signal. The gate shift clock GSC may indicate at least one clock signal for shifting the gate start pulse GSP.

The data control signal may include a source start pulse SSP, a source sampling clock SSC, a source output enable signal SOE, etc. The source start pulse SSP may control a data sampling start timing of the data driver 120. The source sampling clock SSC may control a sampling operation of the data driver 120 on the basis of a rising edge or a falling edge. The source output enable signal SOE may control an output timing of the data driver 120.

The host system 140 may supply the data RGB to the timing controller 130 through an interface (e.g., a predetermined interface). In addition, the host system 140 may supply the timing signals Vsync, Hsync, DE, and CLK to the timing controller 130.

Figure 2:
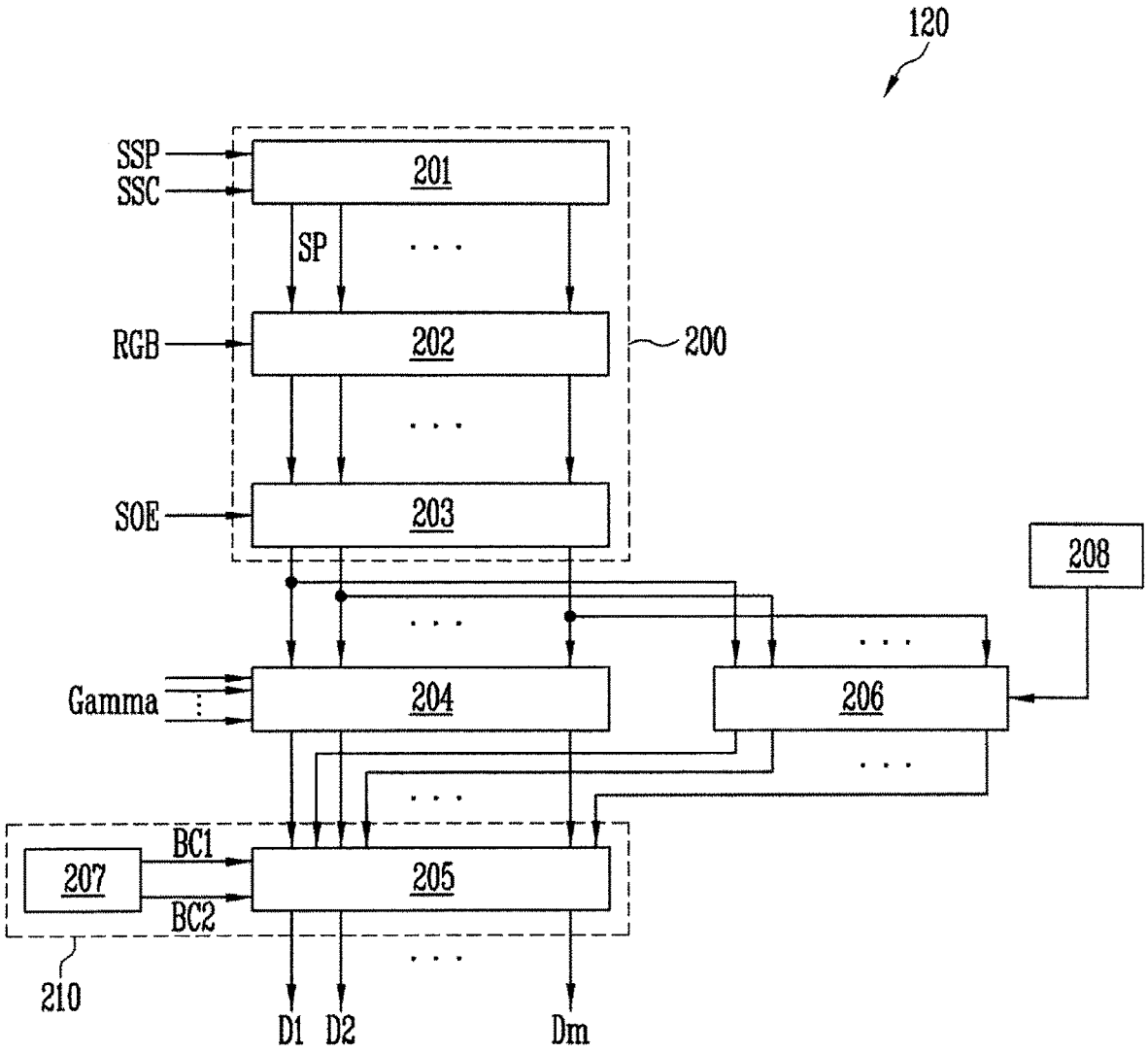
FIG. 2 is a view illustrating an embodiment of a data driver shown in FIG. 1.

FIG. 2 is a view illustrating an embodiment of the data driver 120 shown in FIG. 1.

Referring to FIG. 2, the data driver 120 according to an embodiment of the present disclosure may include an input unit 200, a digital-analog conversion unit 204 (e.g., a digital to analog converter), a data comparator 206, a memory 208, and an output unit 210.

The input unit 200 may receive the data RGB from the timing controller 130 in response to the data control signal SSP, SSC, and SOE. The input unit 200 may include a shift register unit 201, a sampling latch unit 202, and a holding latch unit 203.

The shift register unit 201 may receive the source start pulse SSP and the source sampling clock SSC from the timing controller 130. The shift register unit 201 supplied with the source sampling clock SSC may sequentially generate the sampling pulses SP while shifting the source start pulse SSP for each of the cycles of the source sampling clock SSC. The shift register unit 201 may include a plurality of shift registers.

The sampling latch unit 202 may sequentially store the data RGB corresponding to the sampling pulses SP sequentially supplied from the shift register unit 201. For example, the sampling latch unit 202 may sequentially store the data RGB corresponding to one or more channels corresponding to the sampling pulses SP. The sampling latch unit 202 may include a plurality of sampling latches capable of storing the data RGB corresponding to one or more channels.

The holding latch unit 203 may receive and store the data RGB from the sampling latch unit 202 when the source output enable signal SOE is input. The holding latch unit 203 may concurrently (e.g., simultaneously) receive the data RGB stored in the sampling latch unit 202. In addition, the holding latch unit 203 may supply the data RGB stored therein to the digital-analog conversion unit 204 when the source output enable signal SOE is input. The holding latch unit 203 may include a plurality of holding latches capable of storing the data RGB corresponding to one or more channels.

As illustrated in FIG. 2, only the shift register unit 201, the sampling latch unit 202, and the holding latch unit 203 may be included in the input unit 200, but the present disclosure is not limited thereto. For example, the input unit 200 may additionally have various suitable configurations currently known to those skilled in the art.

The digital-analog conversion unit 204 may generate data signals by using the data RGB. The digital-analog conversion unit 204 may include a digital analog converter (DAC) located in each of the channels. The DAC may select one of gamma voltages Gamma corresponding to the gray scale values of the data RGB supplied thereto and supply the selected gamma voltage Gamma as a data signal to a buffer unit 205.

The memory 208 may store a reference gray scale value (e.g., a reference gray scale value that is set beforehand). The reference gray scale value may be set to a gray scale value of 10% or less when a gray scale range expressed with the data RGB is set to 100%. For example, according to an embodiment when the gray scale value expressed with the data RGB is set to 256 gray scale values, the reference gray scale value may be set to a gray scale value of 25. According to another embodiment, when the gray scale value expressed with the data RGB is set to 256 gray scale values, the reference gray scale value may be set to a gray scale value of 4 or less, for example, a black gray scale value. In addition, the reference gray scale value stored in the memory 208 may be updated when set by a user.

The memory 208 may be set to a register included in the data driver 120. In addition, the reference gray scale value may be supplied from the timing controller 130 to the data comparator 206. The memory 208 may be removed (i.e., may not be present) when the reference gray scale value is supplied from the timing controller 130.

The data comparator 206 may receive the data RGB stored in the holding latch unit 203. For example, the data comparator 206 may concurrently (e.g., simultaneously) receive the data RGB from the holding latch unit 203. The data comparator 206 receiving the data RGB may compare the gray scale values of the data RGB with the reference gray scale value on a per channel basis (or a channel-by-channel basis) (that is, on a per pixel basis or a pixel-by-pixel basis). The data comparator 206 for comparing the gray scale values of the data RGB with the reference gray scale value on a channel basis may supply either a first control signal or a second control signal to the output unit 210 corresponding to a comparison result. The first control signal and the second control signal may be supplied to each of the channels.

For example, the data comparator 206 may compare a gray scale value of data RGB (e.g., predetermined data RGB) corresponding to an ith channel (i is a natural number) with the reference gray scale value. The data comparator 206 may generate the first control signal when the gray scale value of the data RGB (e.g., the predetermined data RGB) is set to more than the reference gray scale value, and the second control signal when the gray scale value of the data RGB (e.g., the predetermined data RGB) is set to the reference gray scale value or less. The first control signal or the second control signal generated by the data comparator 206 may be supplied to an ith buffer included in the buffer unit 205.

The output unit 210 may include a bias current generator 207 and the buffer unit 205.

The bias current generator 207 may generate a first bias current BC1 and a second bias current BC2. The second bias current BC2 may be set to a lower current value than the first bias current BC1.

The buffer unit 205 may include the buffer positioned in each of the channels. The buffer may receive the first bias current BC1 or the second bias current BC2 in response to the first control signal or the second control signal supplied thereto and supply the data signal to the data line D at a slew rate corresponding to the received bias current (e.g., BC1 or BC2).

For example, a buffer located in the ith channel may be supplied with the first bias current BC1 in response to the first control signal. When the first bias current BC1 is supplied to the buffer located in the ith channel, the buffer may be set to have a high slew rate, so that the data signal may be stably supplied to the pixel PXL. That is, the first control signal may correspond to a gray scale value of at least 10% or more, which may be expressed by the display device. When the buffer is set to have the high slew rate, the data signal may be stably supplied to the pixel PXL.

In addition, the buffer located in the ith channel may receive the second bias current BC2 in response to the second control signal. When the second bias current BC2 is supplied to the buffer located in the ith channel, the slew rate of the buffer may be set to be lower than that of the first bias current BC1. That is, the second control signal may correspond to a gray scale value of 10% or less, which may be expressed by the display device, and the data signal may be stably supplied to the pixel PXL although the buffer is set to have a low slew rate. Further, when the second bias current BC2 is supplied to the buffer located in the ith channel, power consumption may be reduced compared to the case in which the first bias current BC1 is supplied.

That is, in an embodiment of the present disclosure, when the gray scale value of the data is more than the reference gray scale value, the first bias current BC1 may be supplied to the buffer, and when the gray scale value of the data is set to be the reference gray scale value or less, the second bias current BC2 may be supplied to the buffer. Accordingly, driving stability may be ensured while power consumption is reduced.

Figure 3:
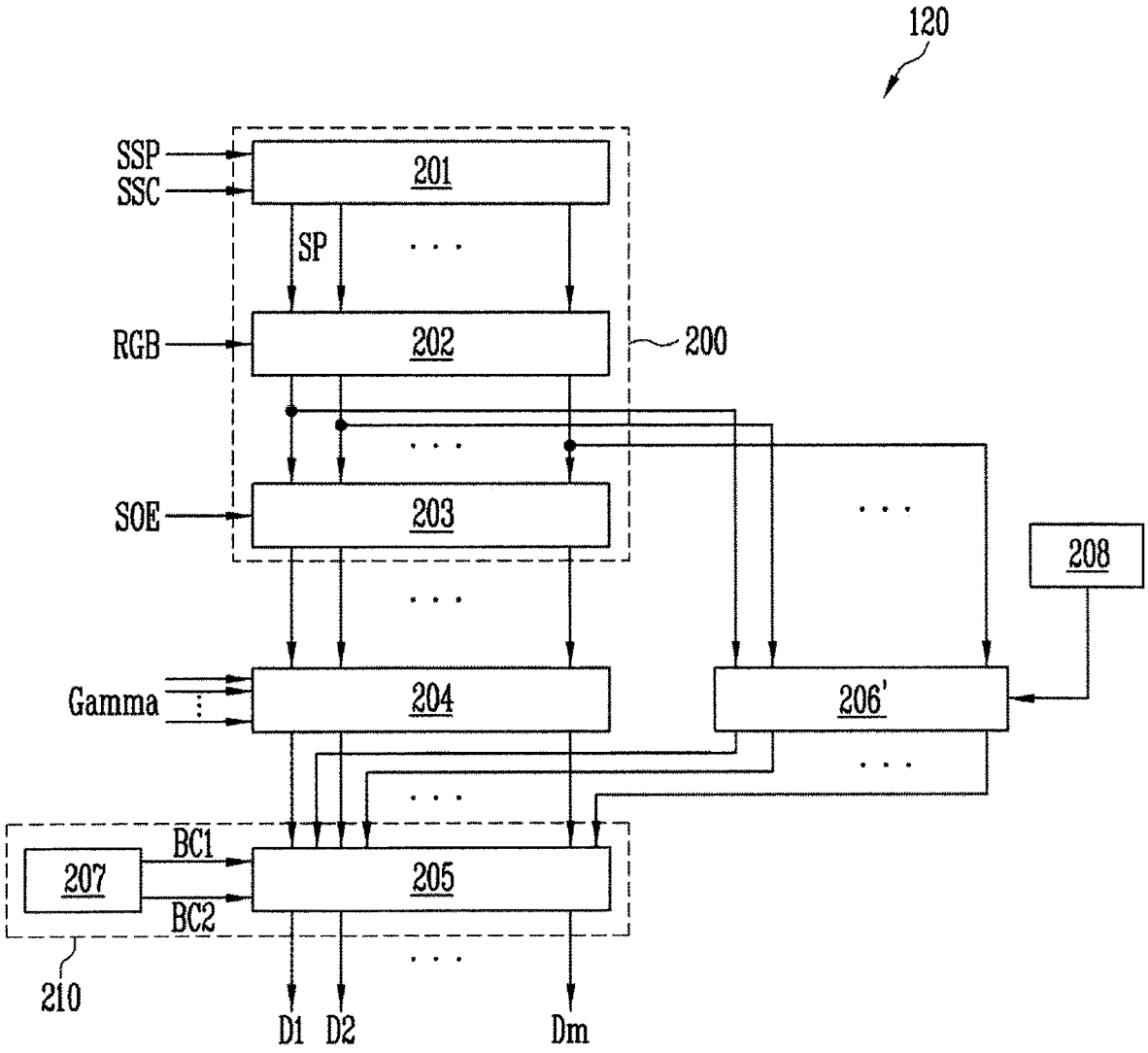
FIG. 3 is a view illustrating another embodiment of the data driver shown in FIG. 1.

FIG. 3 is a view illustrating another embodiment of the data driver shown in FIG. 1. In the description of FIG. 3, the same constituents as those in FIG. 2 are denoted by the same reference numerals, and a detailed description thereof may be omitted.

Referring to FIG. 3, the data driver 120 according to another embodiment of the present disclosure may include the input unit 200, the digital-analog conversion unit 204, a data comparator 206', the memory 208, and the output unit 210.

The data comparator 206' may receive the data RGB stored in the sampling latch unit 202. For example, the data comparator 206' may sequentially receive the data RGB from the sampling latch unit 202. The data comparator 206' supplied with the data RGB may compare gray scale values of the data RGB with a reference gray scale value on a per channel basis (or a channel-by-channel basis) (that is, on a per pixel basis or a pixel-by-pixel basis). The data comparator 206' that compares the gray scale values of the data RGB with the reference gray scale value on a per channel basis may supply either the first control signal or the second control signal to the output unit 210 corresponding to a comparison result.

Figure 4:
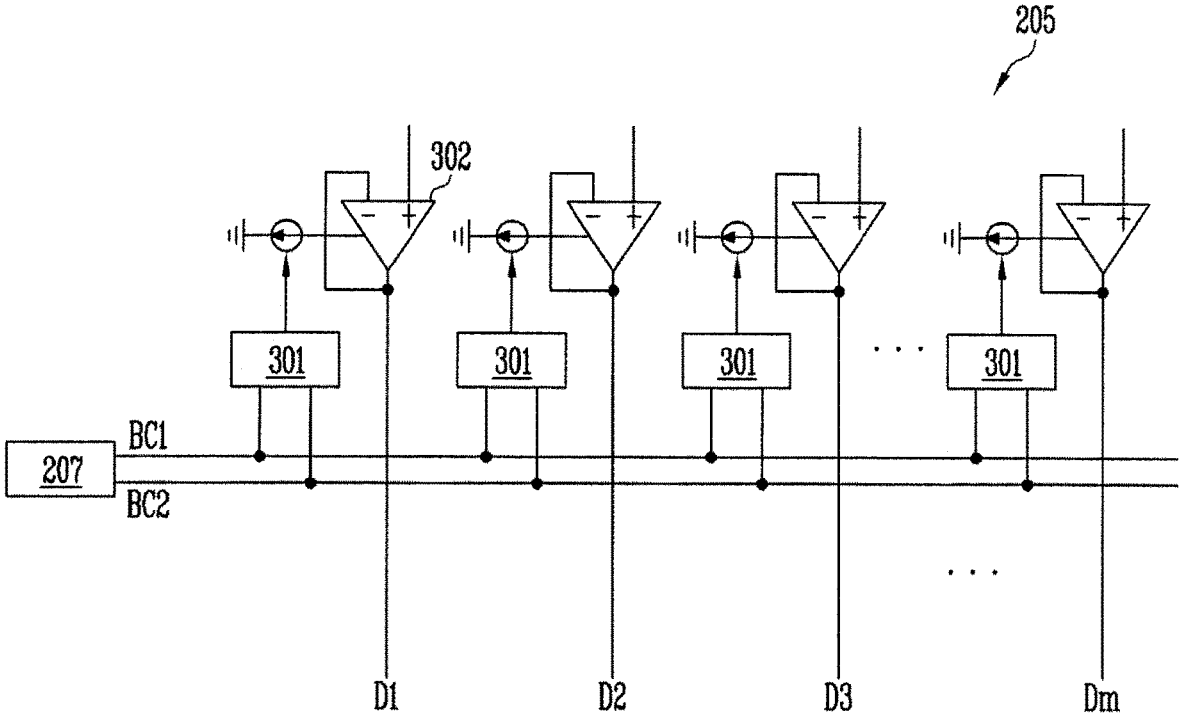
FIG. 4 is a view illustrating an embodiment of a buffer unit shown in FIGS. 2 and 3.

FIG. 4 is a view illustrating an embodiment of a buffer unit shown in FIGS. 2 and 3.

Referring to FIG. 4, each channel of within the buffer unit 205 may include a switch unit 301 and a buffer 302.

A slew rate of the buffer 302 may be controlled corresponding to the first bias current BC1 or the second bias current BC2. For example, the buffer 302 may have a higher slew rate when the first bias current BC1 is supplied than when the second bias current BC2 is supplied.

The switch unit 301 may be located in each of the channels. The switch unit 301 may receive a first control signal or a second control signal from the data comparators 206 and/or 206'. The switch unit 301 supplied with the first control signal may supply the first bias current BC1 to the buffer 302. In addition, the switch unit 301 supplied with the second control signal may supply the second bias current BC2 to the buffer 302. Thus, the slew rate of the buffer 302 may be controlled corresponding to the first bias current BC1 or the second bias current BC2 supplied thereto and the buffer 302 may supply the data signal supplied from the digital-analog conversion unit 204 to the data line (one of the data lines D1 to Dm) connected thereto.

Figure 5:
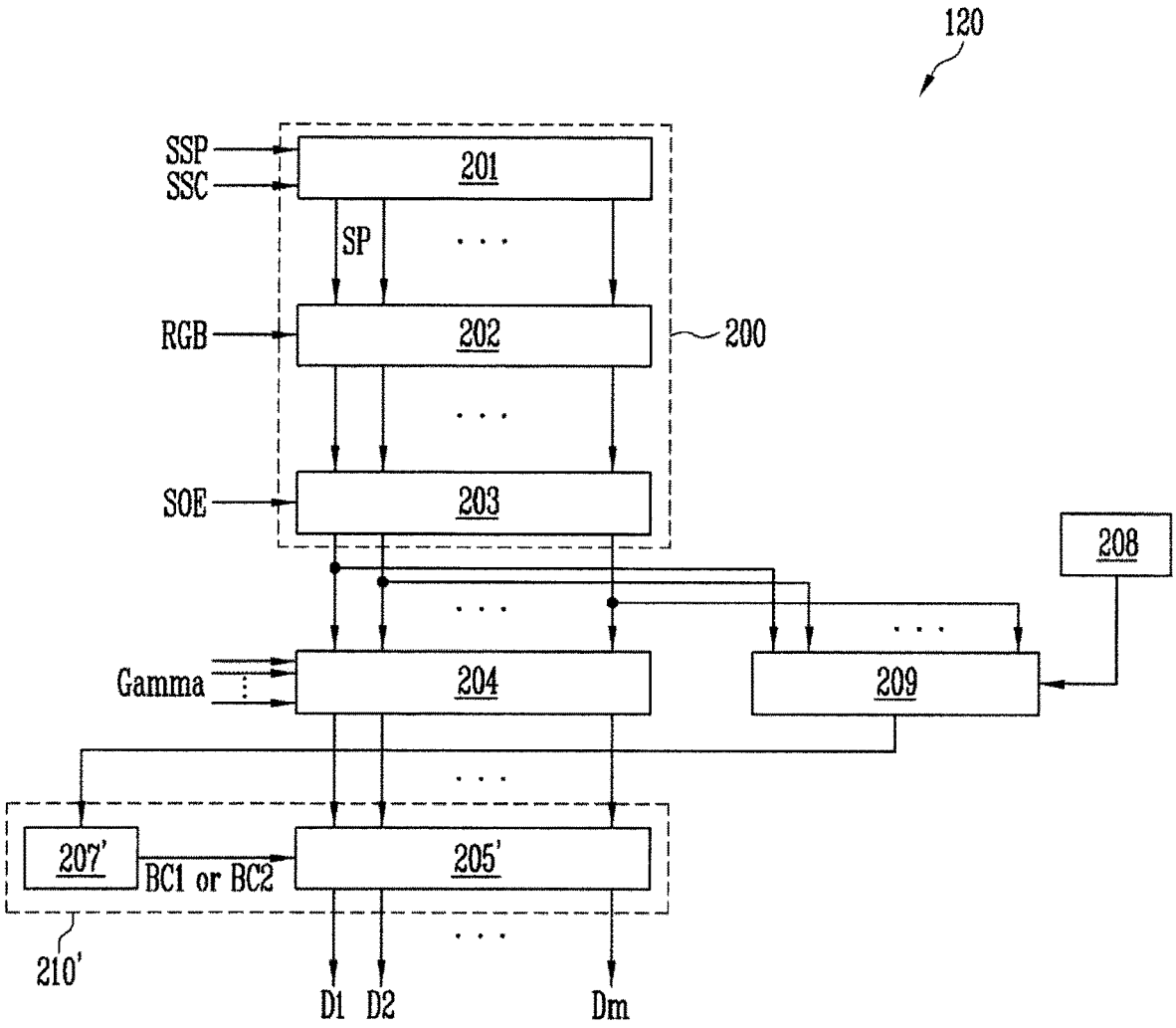
FIG. 5 is a view illustrating another embodiment of the data driver shown in FIG. 1.

FIG. 5 is a view illustrating another embodiment of the data driver shown in FIG. 1. In the description of FIG. 5, the same constituents as those in FIG. 2 are denoted by the same reference numerals, and a detailed description thereof may be omitted.

Referring to FIG. 5, the data driver 120 according to another embodiment of the present disclosure may include the input unit 200, the digital-analog conversion unit 204, a data comparator 209, the memory 208, and an output unit 210'.

The input unit 200 may receive the data RGB from the timing controller 130 in response to a data control signal (SSP, SSC, and SOE). The input unit 200 may include the shift register unit 201, the sampling latch unit 202, and the holding latch unit 203.

The digital-analog conversion unit 204 may generate data signals by using the data RGB. The digital-analog conversion unit 204 may have a digital-analog converter (DAC) located in each of the channels. The DAC may select one of the gamma voltages Gamma corresponding to the gray scale value of the data RGB supplied thereto and supply the selected gamma voltage to the buffer unit 205' as the data signal.

The memory 208 may store a reference gray scale value (e.g., a reference gray scale value that is set beforehand).

The data comparator 209 may receive the data RGB stored in the holding latch unit 203. For example, the data comparator 209 may concurrently (e.g., simultaneously) receive the data RGB from the holding latch unit 203. The data comparator 209 supplied with the data RGB may compare the gray scale values of the data RGB with the reference gray scale value on a per horizontal line basis (or a horizontal line-by-horizontal line basis). The data comparator 209 that compares the gray scale values of the data RGB with the reference gray scale value on a per horizontal line basis may supply either a first control signal or a second control signal to the output unit 210 corresponding to a comparison result.

The data comparator 209 may generate the first control signal when at least one of the data stored in the holding latch unit 203 is more that the reference gray scale value, and otherwise generate the second control signal.

The output unit 210' may include a bias current generator 207' and a buffer unit 205'.

The bias current generator 207' may supply the first bias current BC1 or the second bias current BC2 to the buffer unit 205' in response to the first control signal or the second control signal. For example, the bias current generator 207' may supply the first bias current BC1 to the buffer unit 205' in response to the first control signal and the second bias current BC2 to the buffer unit 205' in response to the second control signal.

The buffer unit 205' may include a buffer positioned at each of the channels. A slew rate of the buffer may be set corresponding to the first bias current BC1 or the second bias current BC2 supplied from the bias current generator 207'. The buffer may supply the data signal supplied from the digital-analog conversion unit 204 to one of the data lines D1 to Dm connected thereto at the slew rate corresponding to the first bias current BC1 or the second bias current BC2.

Figure 6:
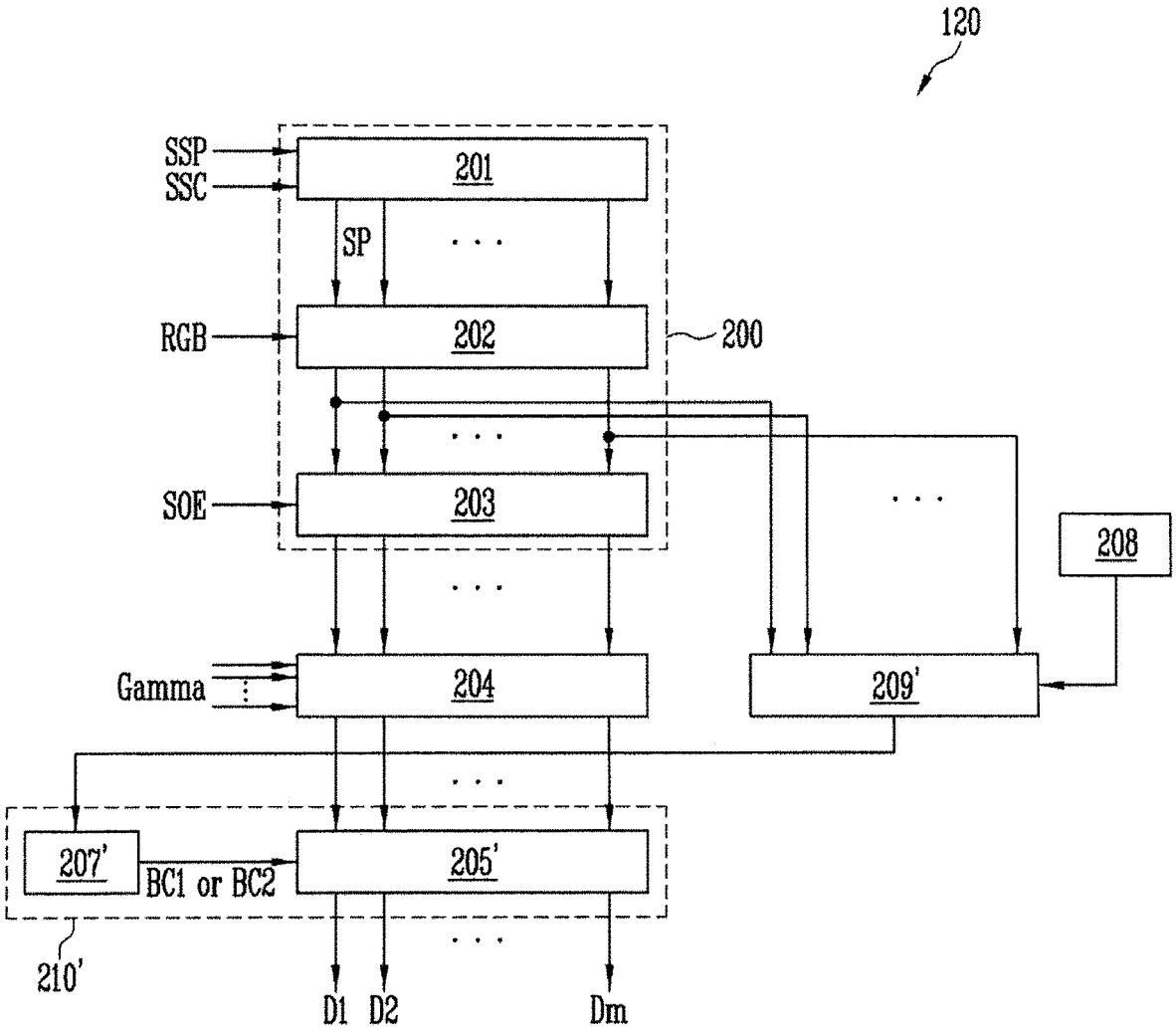
FIG. 6 is a view illustrating another embodiment of the data driver shown in FIG. 1.

FIG. 6 is a view illustrating another embodiment of the data driver shown in FIG. 1. In the description of FIG. 6, the same constituents as those in FIG. 5 are denoted by the same reference numerals, and a detailed description thereof may be omitted.

Referring to FIG. 6, the data driver 120 according to another embodiment of the present disclosure may include the input unit 200, the digital-analog conversion unit 204, a data comparator 209', the memory 208, and the output unit 210'.

The data comparator 209' may receive the data RGB stored in the sampling latch unit 202. For example, the data comparator 209' may sequentially receive the data RGB from the sampling latch unit 202. The data comparator 209' supplied with the data RGB may compare gray scale values of the data RGB with a reference gray scale value on a per horizontal line basis. The data comparator 209' that compares the gray scale values of the data RGB with the reference gray scale value on the per horizontal line basis may supply either a first control signal or a second control signal to the output unit 210'.

Figure 7:
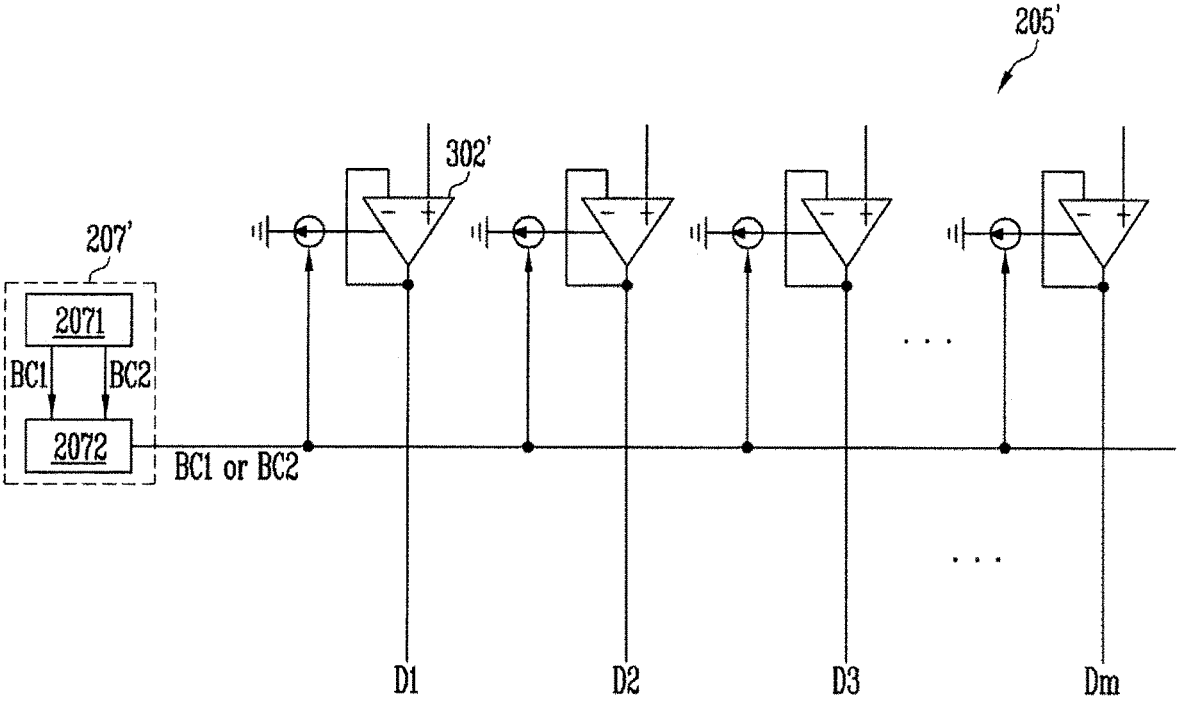
FIG. 7 is a view illustrating an embodiment of a bias current generator and a buffer unit shown in FIGS. 5 and 6.

FIG. 7 is a view illustrating embodiments of the bias current generator 207' and the buffer unit 205' shown in FIGS. 5 and 6.

Referring to FIG. 7, the bias current generator 207' according to an embodiment of the present disclosure may include a current generator 2071 and a switch unit 2072.

The current generator 2071 may generate the first bias current BC1 and the second bias current BC2 and supply the generated first bias current BC1 and second bias current BC2 to the switch unit 2072. The second bias current BC2 may be set to a lower current value than the first bias current BC1.

The switch unit 2072 may receive the first bias current BC1 and the second bias current BC2 from the current generator 2071. In addition, the switch unit 2072 may receive the first control signal or the second control signal from the data comparators 209 and/or 209'.

The switch unit 2072 may supply the first bias current BC1 to the buffer unit 205' when the first control signal is supplied. In addition, the switch unit 2072 may supply the second bias current BC2 to the buffer unit 205' when the second control signal is supplied.

The buffer unit 205' may include a buffer 302' located in each of the channels.

A slew rate of the buffer 302' may be controlled corresponding to the first bias current BC1 or the second bias current BC2. For example, the buffer 302' may have a higher slew rate when the second bias current BC2 is supplied than when the first bias current BC1 is supplied.

The slew rate of the buffer 302' may be controlled corresponding to the first bias current BC1 or the second bias current BC2 supplied from the bias current generator 207' and the buffer 302' may supply the data signal from the digital-analog conversion unit 204 to one of the data lines D1 to Dm connected thereto.

As described above, in an embodiment of the present disclosure, the gray scale values of the data RGB may be compared with the reference gray scale value on the per pixel basis or the per horizontal line basis, and the slew rates of the buffers 302 and 302' may be controlled corresponding to the comparison result. As a result, driving stability may be ensured while power consumption is reduced.

According to a data driver and a driving method thereof in accordance with an embodiment of the present disclosure, when a gray scale value of data is more than a reference gray scale value (e.g., a predetermined reference gray scale value) a first bias current may be supplied to a buffer. Otherwise, a second bias current having a lower current value than the first bias current may be supplied to the buffer.

Data signals corresponding to more than the reference gray scale value may be stably supplied to pixels by a buffer having a high slew rate. In addition, data signals corresponding to the reference gray scale value or less may be supplied to the pixels by a buffer having a low slew rate, so that power consumption may be reduced. The data signals corresponding to the reference gray scale value or less may be stably supplied to the pixels although the buffer is set to have a low slew rate. That is, in an embodiment of the present disclosure, driving stability may be ensured while power consumption is reduced.

It will be understood that, although the terms "first," "second," "third," etc., may be used herein to describe various elements, components, regions, layers, and/or sections, these elements, components, regions, layers, and/or sections should not be limited by these terms. These terms are used to distinguish one element, component, region, layer, or section from another element, component, region, layer, or section. Thus, a first element, component, region, layer, or section discussed below could be termed a second element, component, region, layer, or section without departing from the spirit and scope of the present invention.

A relevant device or component (or relevant devices or components) according to embodiments of the present invention described herein may be implemented utilizing any suitable hardware (e.g., an application-specific integrated circuit), firmware (e.g., a DSP or FPGA), software, or a suitable combination of software, firmware, and hardware. For example, the various components of the relevant device (s) may be formed on one integrated circuit (IC) chip or on separate IC chips. Further, the various components of the relevant device(s) may be implemented on a flexible printed circuit film, a tape carrier package (TCP), a printed circuit board (PCB), or formed on a same substrate as one or more circuits and/or other devices. Further, the various components of the relevant device(s) may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Further, it will also be understood that when one element, component, region, layer, and/or section is referred to as being "between" two elements, components, regions, layers, and/or sections, it can be the only element, component, region, layer, and/or section between the two elements, components, regions, layers, and/or sections, or one or more intervening elements, components, regions, layers, and/or sections may also be present.

The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprise," "comprises," "comprising," "includes," "including," and "include," when used in this specification, specify the presence of stated features, integers, steps, operations, elements, and/or components, but do not preclude the presence or addition of one or more other features, integers, steps, operations, elements, components, and/or groups thereof.

As used herein, the term "and/or" includes any and all combinations of one or more of the associated listed items. Expressions such as "at least one of," "one of," and "selected from," when preceding a list of elements, modify the entire list of elements and do not modify the individual elements of the list. Further, the use of "may" when describing embodiments of the present invention refers to "one or more embodiments of the present invention." Also, the term "exemplary" is intended to refer to an example or illustration.

It will be understood that when an element or layer is referred to as being "on," "connected to," "coupled to," "connected with," "coupled with," or "adjacent to" another element or layer, it can be "directly on," "directly connected to," "directly coupled to," "directly connected with," "directly coupled with," or "directly adjacent to" the other element or layer, or one or more intervening elements or layers may be present. Furthermore, "connection," "connected," etc., may also refer to "electrical connection," "electrically connected," etc., depending on the context in which such terms are used as would be understood by those skilled in the art. When an element or layer is referred to as being "directly on," "directly connected to," "directly coupled to," "directly connected with," "directly coupled with," or "immediately adjacent to" another element or layer, there are no intervening elements or layers present.

As used herein, "substantially," "about," and similar terms are used as terms of approximation and not as terms of degree, and are intended to account for the inherent deviations in measured or calculated values that would be recognized by those of ordinary skill in the art.

As used herein, the terms "use," "using," and "used" may be considered synonymous with the terms "utilize," "utilizing," and "utilized," respectively.

Features described in relation to one or more embodiments of the present invention are available for use in conjunction with features of other embodiments of the present invention. For example, features described in a first embodiment may be combined with features described in a second embodiment to form a third embodiment, even though the third embodiment may not be specifically described herein.

A person of skill in the art should also recognize that the process may be executed via hardware, firmware (e.g., via an ASIC), or in any combination of software, firmware, and/or hardware. Furthermore, the sequence of steps of the process is not fixed, but can be altered into any desired sequence as recognized by a person of skill in the art. The altered sequence may include all of the steps or a portion of the steps.

Embodiments are provided to more sincerely and fully disclose the disclosure and to completely transfer the spirit of the disclosure to those skilled in the art to which the disclosure pertains, and the scope of the disclosure should be understood by the claims of the disclosure and their equivalents. Accordingly, it will be understood by those of skill in the art that various suitable changes in form and details may be made without departing from the spirit and scope of the disclosure as set forth in the following claims.

While the scope of the rights to the above-described disclosure is set forth in the following claims, it is to be understood that the disclosure is not limited to the disclosed embodiments, but is intended to cover various modifications and equivalent arrangements included within the spirit and scope of the appended claims and their equivalents.

What is claimed is:

1. A data driver, comprising:

an input unit configured to receive data from outside;

a digital-to-analog converter configured to generate a data signal by using the received data;

a data comparator configured to compare a reference gray scale value with the received data and to generate a first control signal or a second control signal corresponding to a comparison result; and an output unit configured to supply the data signal to data lines, wherein the output unit comprises at least one buffer, and a slew rate of the at least one buffer is set to vary depending on whether the first control signal or the second control signal is generated, and wherein the reference gray scale value is set to a gray scale value of 10% or less when a gray scale range expressed with the received data is set to 100%.

2. The data driver of claim 1, wherein the reference gray scale value is set to a black gray scale value.

3. The data driver of claim 1, further comprising a memory configured to store the reference gray scale value.

4. The data driver of claim 1, wherein the input unit comprises:

a shift register unit configured to sequentially output a sampling pulse;

a sampling latch unit configured to sequentially store the received data corresponding to the sampling pulse; and a holding latch unit configured to receive and to store the received data from the sampling latch unit and to supply stored data to the digital-to-analog converter.

5. The data driver of claim 4, wherein the sampling latch unit is configured to supply the received data to the data comparator.

6. The data driver of claim 4, wherein the holding latch unit configured to supply the received data to the data comparator.

7. A data driver, comprising:

an input unit configured to receive data from outside;

a digital-to-analog converter configured to generate a data signal by using the received data;

a data comparator configured to compare a reference gray scale value with the received data and to generate a first control signal or a second control signal corresponding to a comparison result; and an output unit configured to supply the data signal to data lines, wherein the output unit comprises at least one buffer, and a slew rate of the at least one buffer is set to vary depending on whether the first control signal or the second control signal is generated, wherein the data comparator is configured to compare the reference gray scale value with the received data for each of a plurality of channels, and wherein the data comparator is configured to generate the first control signal when a gray scale value of the received data corresponding to an ith (i is a natural number) channel is more than the reference gray scale value, and the second control signal when the gray scale value of the received data is set to the reference gray scale value or less.

8. The data driver of claim 7, wherein the output unit is configured to supply a first bias current to the at least one buffer in response to the first control signal, and a second bias current, having a lower current value than the first bias current, to the at least one buffer in response to the second control signal.

9. The data driver of claim 7, wherein the output unit comprises:

a bias current generator configured to generate a first bias current and a second bias current having a lower current value than the first bias current; and a buffer unit comprising the at least one buffer and being configured to supply the data signal to the data lines.

10. The data driver of claim 9, wherein the buffer unit comprises:

a plurality of buffers comprising the at least one buffer, each of the plurality of channels corresponding to a respective one of the plurality of buffers, wherein a slew rate of each of the plurality of buffers is configured to be controlled corresponding to a bias current; and a switch unit at each of the plurality of channels configured to supply the first bias current to the at least one buffer when the first control signal is supplied, and the second bias current, having the lower current value than the first bias current, to the at least one buffer when the second control signal is supplied.

11. A data driver, comprising:

an input unit configured to receive data from outside;

a digital-to-analog converter configured to generate a data signal by using the received data;

a data comparator configured to compare a reference gray scale value with the received data and to generate a first control signal or a second control signal corresponding to a comparison result; and an output unit configured to supply the data signal to data lines, wherein the output unit comprises at least one buffer, and a slew rate of the at least one buffer is set to vary depending on whether the first control signal or the second control signal is generated, wherein the data comparator is configured to compare the reference gray scale value with the received data on a per horizontal line basis, and wherein the data comparator is configured to generate the first control signal when at least one of line data corresponding to one horizontal line is more than the reference gray scale value, and otherwise to generate the second control signal.

12. The data driver of claim 11, wherein the output unit is configured to supply a first bias current to the at least one buffer in response to the first control signal and a second bias current, having a lower current value than the first bias current, to the at least one buffer in response to the second control signal.

13. The data driver of claim 11, wherein the output unit comprises:

a current generator configured to generate a first bias current and a second bias current having a lower current value than the first bias current;

a switch unit configured to output the first bias current when the first control signal is input, and to output the second bias current when the second control signal is input to the at least one buffer on each of a plurality of channels, and wherein the slew rate thereof is configured to be controlled corresponding to the first bias current or the second bias current supplied from the switch unit.

14. A method of driving a data driver, the method comprising:

receiving data;

comparing the received data with a reference gray scale value; and controlling a slew rate of a buffer included in each of a plurality of channels corresponding to a comparison result, wherein the buffer has a first slew rate when the received data is more than the reference gray scale value, and the buffer has a second slew rate, which is lower than the first slew rate, when the received data is the reference gray scale value or less.

15. The method of claim 14, wherein the reference gray scale value is set to a gray scale value of 10% or less when a gray scale range expressed with the received data is set to 100%.

16. The method of claim 14, wherein the comparing of the received data with the reference gray scale value comprises comparing the received data with the reference gray scale value for each of the plurality of channels or on a per horizontal line basis.

* * * * *